US011476073B2

(12) United States Patent
Wilhelm et al.

(10) Patent No.: US 11,476,073 B2
(45) Date of Patent: Oct. 18, 2022

(54) USE OF A FUSE FOR A DIRECT CURRENT TRANSMISSION

(71) Applicant: SIBA Fuses GmbH, Lünen (DE)

(72) Inventors: Dirk Wilhelm, Lünen (DE); Jens Weber, Dortmund (DE); Johannes-Georg Gödeke, Lünen (DE)

(73) Assignee: SIBA Fuses GmbH, Lünen (DE)

( * ) Notice: Subject to any disclaimer, the term of this patent is extended or adjusted under 35 U.S.C. 154(b) by 0 days.

(21) Appl. No.: 17/261,121

(22) PCT Filed: Nov. 18, 2019

(86) PCT No.: PCT/EP2019/081648
§ 371 (c)(1),
(2) Date: Jan. 18, 2021

(87) PCT Pub. No.: WO2020/104372
PCT Pub. Date: May 28, 2020

(65) Prior Publication Data

US 2021/0287868 A1 Sep. 16, 2021

(30) Foreign Application Priority Data

Nov. 23, 2018 (DE) ..... 10 2018 009 183.0

(51) Int. Cl.
*H01H 85/042* (2006.01)
*H01H 85/165* (2006.01)

(52) U.S. Cl.
CPC ..... *H01H 85/042* (2013.01); *H01H 85/165* (2013.01)

(58) Field of Classification Search
CPC .... H01H 85/042; H01H 85/12; H01H 85/165; H01H 85/185
See application file for complete search history.

(56) References Cited

U.S. PATENT DOCUMENTS 3,222,479 A * 12/1965 Franklin ..... H01H 85/042 337/159
3,851,290 A * 11/1974 Stover ..... H01H 85/47 337/166
4,225,840 A * 9/1980 Jacobs, Jr. ..... H01H 85/185 337/273
4,339,742 A * 7/1982 Leach ..... H01H 85/42 337/279

(Continued)

FOREIGN PATENT DOCUMENTS

CN 207303028 U 5/2018
EP 2874174 A1 5/2015

(Continued)

OTHER PUBLICATIONS

Oshima, JP2004014241A Translation. (Year: 2004).*

(Continued)

*Primary Examiner* — Jacob R Crum
(74) *Attorney, Agent, or Firm* — Jason H. Vick; Sheridan Ross, PC

(57) ABSTRACT

The invention relates to a use of a high-voltage high-power fuse for securing direct current transmission, wherein the direct voltage of the direct current and/or the rated voltage of the high voltage fuse (1) is greater than 4 kV.

17 Claims, 5 Drawing Sheets

(56) References Cited

Figure 1A:
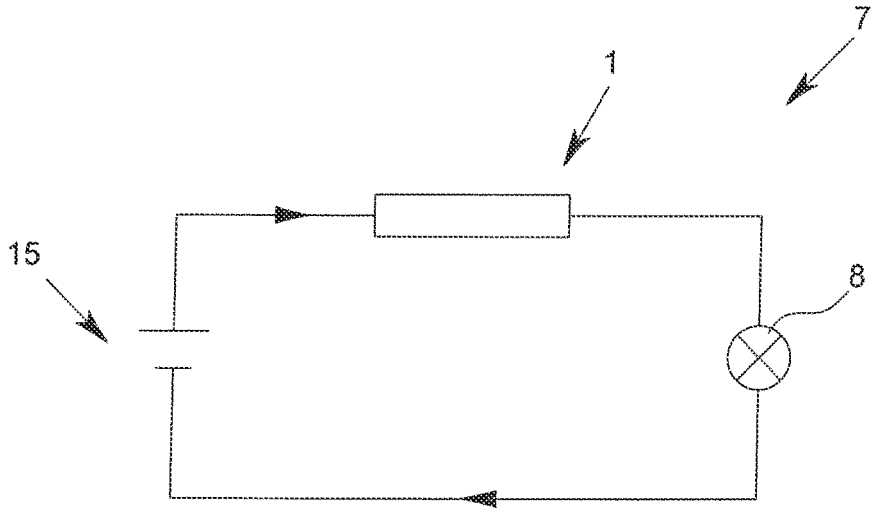

U.S. PATENT DOCUMENTS 4,367,451 A * 1/1983 Panaro ..... H01H 85/055 337/296
4,486,734 A * 12/1984 Leach ..... H01H 85/38 337/158
4,636,765 A * 1/1987 Krueger ..... H01H 85/0458 337/279
5,670,926 A * 9/1997 Ranjan ..... H01H 85/185 337/158
5,892,427 A * 4/1999 Handcock ..... H01H 85/042 337/229
2002/0101323 A1* 8/2002 Ranjan ..... H01H 85/143 337/158
2002/0109574 A1* 8/2002 Handcock ..... H01H 85/055 337/292
2007/0257807 A1* 11/2007 Darr ..... H02H 3/042 340/635
2007/0285867 A1* 12/2007 Muench ..... H01H 85/042 361/159
2013/0271888 A1* 10/2013 Falk ..... H02H 9/041 361/93.1
2016/0133423 A1* 5/2016 Cwalina ..... H01H 85/042 337/159

FOREIGN PATENT DOCUMENTS

EP 3270403 A1 1/2018
JP 2004014241 A * 1/2004
PL 64376 Y1 4/2009

OTHER PUBLICATIONS

International Search Report for International Application No. PCT/EP2019/081648, dated Jan. 30, 2020.
Written Opinion for International Application No. PCT/EP2019/081648, dated Jan. 30, 2020.
International Preliminary Report on Patentability for International Application No. PCT/EP2019/081648, dated Oct. 14, 2020.

* cited by examiner

USE OF A FUSE FOR A DIRECT CURRENT TRANSMISSION

CROSS REFERENCE TO RELATED APPLICATIONS

This application is a national stage application under 35 U.S.C. 371 of PCT Application No. PCT/EP2019/081648 having an international filing date of 18 Nov. 2019, which designated the United States, which PCT application claimed the benefit of German Application No. 10 2018 009 183.0, filed 23 Nov. 2018, each of which are incorporated herein by reference in their entirety.

The invention relates to a use of a fuse for a direct current transmission.

A direct current transmission, especially a high-voltage direct current transmission connection (HVDC transmission connection) and/or a medium-voltage direct current transmission connection (MVDC transmission connection), is preferred for power transmission over comparatively long distances, for example over 100 km, from a technical point of view with regard to the reduced transmission losses.

It has been shown that direct current transmission can reduce energy losses compared to alternating current transmission. With a HVDC connection, usually approx. 30% to 50% less transmission losses are possible than with comparable three-phase overhead lines. Transmission in the medium-voltage direct current range is also connected with significantly lower transmission losses compared to transmission with alternating and/or three-phase current.

Particularly in the course of the "energy turnaround", transmission links for electricity are needed that are as low-loss as possible, so that, for example, electricity from offshore wind farms can be transmitted with low losses to the mainland and far into the mainland.

However, with HVDC or MVDC connections, it is disadvantageous that in practice—if at all—only inadequate or, at best, sufficient security of DC transmission can be guaranteed. Particularly for HVDC or MVDC connections, no fuses are known in practice that can withstand the long-term load of the DC transmission on the one hand and on the other hand can safely switch off the transmitting DC current in case of a short circuit. As a consequence, direct currents cannot be effectively protected, especially in sections and/or in case of a compact, small-sized and/or short-length design. As a consequence, it is—in contrast to alternating current—not possible in the state of the art to connect several consumers to a direct current transmission network.

For the low voltage range, fuses for use in DC circuits are known to be state of the art. However, these are not suitable and/or usable for the high voltage and/or medium voltage direct current range. EP 3 270 403 A1, for example, concerns such a low-voltage fuse for a direct voltage circuit.

The object of the present invention is now to avoid or at least substantially reduce the aforementioned disadvantages in the prior art.

According to the invention, the aforementioned object is at least essentially solved by using a high-voltage high-power fuse to protect a direct current transmission, wherein the direct voltage of the direct current and/or the rated voltage of the high voltage fuse is greater than 4 kV. The high voltage high capacity fuse is called high voltage fuse in the following. Consequently, the high voltage fuse is especially used in a direct voltage circuit.

High voltage fuses are known in practice for protecting alternating current. They are especially used for protecting AC voltages above 1 kV, preferably between 1 kV and 100 kV. Such high voltage fuses are now used for DC transmission according to the invention.

When the invention came about, it was surprisingly discovered that high voltage fuses are particularly suitable for direct current transmission, especially for HVDC or MVDC connections. Thus, high direct currents and/or high direct voltages can be protected with the high voltage fuse. Until now, the state of the art has refrained from using the high voltage fuse known from the field of alternating current transmission for direct current transmission. Especially the fuse in the medium voltage and/or high voltage range is linked with a multitude of conditions and standards to be observed. A high sensitivity and caution towards the danger potential resulting from high voltages or currents has led to the fact that known fuses have not been used "randomly" to transmit different types of current. Up to now, fuses have always been used for a special, correspondingly declared purpose. Especially for direct current transmission there has not been a sufficient solution due to the expected problems.

If one of the consumers and/or users electrically connected to the DC transmission network were to cause a short circuit, the entire DC network would fail. Accordingly, in practice, fuses in direct current networks and/or direct current transmission have been abandoned, since the fuse required for a stable and safe power network and/or direct voltage circuit could not be permanently guaranteed.

Surprisingly and unpredictably, however, according to the invention it has been found that, if the high voltage fuse is used for DC transmission, the necessary safety, especially in case of overload and/or in case of a short circuit, can be guaranteed. It has especially been determined that in case of overload and also in case of short circuit, damage to the fuse box of the high voltage fuse, especially connected with a leakage of extinguishing agent and/or with an electric arc, can be prevented. In simulated long-term tests it has been determined that even with long-term use of the high voltage fuse for securing direct current transmission, e.g. for a period of more than five years, preferably more than ten years, even more preferably more than 15 years, the required safety guidelines and/or regulations, especially those prescribed by law, can be observed.

Thus, according to the invention, a fuse can be provided which can be used for DC transmission in the medium voltage and/or high voltage level. Especially according to the invention, it is possible to connect a number of consumers and/or users to the direct current connection and/or to the direct voltage circuit, which are afterwards protected by at least one high voltage fuse. In case of failure of a consumer, especially in case of a short-circuit, the direct current transmission network does not break down.

A sectional fuse protection of the DC network can preferably be provided by means of the high voltage fuses.

The high voltage fuse used according to the invention is a fuse which, as an overcurrent protection device, interrupts the circuit by melting a melting conductor if the current exceeds a certain value for a sufficient time. Preferably, the time required to switch the fuse is very short, especially in the millisecond range.

A preferred embodiment of the invention provides that the high voltage fuse comprises a fuse box which is at least partially open at two end faces. At least one contact cap designed for electrical contact is arranged at each end face of the fuse box. In the fuse box at least one melting conductor is arranged around a, preferably star-shaped, melting conductor carrier, preferably spirally and/or in a helix form. The length of the high voltage fuse can be held as short as possible by the winding of the at least one fuse element, since the length of the fuse conductor can be increased by the especially helical and/or spiral winding.

For the transmission of the DC voltage the required length of the melting conductor is used, which does not correspond to the length of the complete high voltage fuse, because the melting conductor is wound around the melting conductor carrier. In the end the length of the melting conductor is greater to much greater than the length of the high voltage fuse.

Preferably, the melting conductor carrier is designed in such a way that the melting conductor, especially at least essentially at each turn, lies punctual—if necessary at several points of support. As a result, the melting conductor carrier may comprise protrusions and depressions between the protrusions. An at least essentially star-shaped design of the melting conductor carrier is most preferably.

Especially the characteristic values and/or rated values, preferably the rated voltage and/or rated current range, for the respective high voltage fuse to be used in a direct voltage circuit must be determined and/or established. Preferably, these characteristic values differ from the characteristic values of an AC high voltage fuse. Preferably, the measurement voltage and/or the rated current strength range of the high voltage fuse according to the invention is reduced and/or decreased by more than 20%, preferably more than 30%, even more preferably more than 50%, and/or between 10% to 90%, preferably between 20% to 80%, even more preferably between 40% to 70%, compared to an AC high voltage fuse of the same type.

Preferably, the DC voltage of the transmitting DC current and/or the rated voltage or the rated voltage range of the high voltage fuse is greater than 5 kV, preferably greater than 10 kV, further preferably greater than 15 kV. Alternatively or additionally, it is intended that the DC voltage and/or the rated voltage of the high voltage fuse is less than 150 kV, preferably less than 100 kV, more preferably less than 75 kV, more preferably less than 52 kV, and/or is between 4 kV to 100 kV, preferably between 5 kV to 80 kV, more preferably between 10 kV to 52 kV. The rated voltage and/or rated voltage range of the high voltage fuse is especially the voltage or the voltage range at which the fuse is used and/or tested for the fuse. Basically, a distinction is to be made between an upper rated voltage and a lower rated voltage, wherein the lower rated voltage provides the voltage at which the high voltage fuse still switches, while the upper rated voltage represents the upper limit for the DC voltage to be transmitted. Consequently, the rated voltage or rated voltage range provides the permissible voltage range of the high voltage fuse. Especially, the rated voltage range corresponds to the DC voltage range which can be protected by the high voltage fuse.

In another particularly preferred embodiment, the smallest breaking current of the high voltage fuse is greater than 3 A, preferably greater than 5 A, even more preferably greater than 10 A. Alternatively or additionally, it is provided that the smallest breaking current of the high voltage fuse is less than 1 kA, preferably less than 500 A, more preferably less than 300 A, and/or is between 3 A and 700 A, preferably between 5 A and 500 A, more preferably between 15 A and 300 A. The smallest breaking current is the rated value of the minimum breaking current. From this current value on, the high voltage fuse is able to switch the overcurrent. Consequently, especially the electrical components (consumer, direct current source, etc.) must be arranged and/or designed to the high voltage fuse(s) in such a way that no overcurrent can occur at the inlet point of the fuse which falls below the minimum breaking current. The smallest breaking current can depend on the selected type of the high voltage fuse. According to the invention, it is therefore possible to switch off comparatively low currents of the direct current at a high direct voltage.

Preferably, the rated breaking capacity is designed to be greater than 1 kA, preferably greater than 10 kA, further preferably greater than 20 kA, and/or is between 1 kA to 100 kA, preferably between 10 kA to 80 kA, further preferably between 10 kA to 50 kA. The rated breaking capacity of the high voltage fuse is especially the rated value of the highest breaking current. The highest breaking current is the direct current which the fuse can switch at maximum. Consequently, the rated breaking capacity of the high voltage fuse should be greater than the maximum short-circuit current at the point of use of the high voltage fuse.

In addition, according to a further embodiment of the invention, the direct current which is transmitted and protected by the high voltage fuse and/or the rated current range is greater than 5 A, preferably greater than 10 A, even more preferably greater than 15 A. Alternatively or additionally, it is provided that the direct current is between 3 A to 100 kA, preferably between 10 A to 75 kA, even more preferably between 15 A to 50 kA. Especially, the range of the current intensity of the direct current to be transmitted is specified as a function of the rated breaking capacity and the lowest breaking current of the high voltage fuse.

Finally, it is understood that as a function of the respective direct current transmission different high voltage fuses can be provided, which can be designed for the respective application. Thus, the type of the high voltage fuse can be selected especially as a function of the direct current and/or the direct voltage to be transmitted.

Furthermore, the product (mathematical multiplication) of the direct current protected by the high voltage fuse and the direct voltage is preferably greater than 5 kW, preferably greater than 50 kW, even more preferably greater than 700 kW. Alternatively or additionally, it is intended that the product of the direct current protected by the high voltage fuse and the direct voltage is less than 3000 MW, preferably less than 2000 MW, even more preferably less than 1000 MW, and/or is between 5 kW and 3000 MW, preferably between 500 kW and 2000 MW, even more preferably between 700 kW and 1000 MW.

In particular, the product of the DC current and voltage protected by the high voltage fuse can correspond to the power of the consumer and/or consumers protected by the high voltage fuse (total power). In the end, the above-mentioned product corresponds especially to the power which can be protected by the high voltage fuse.

According to another preferred embodiment, the high voltage fuse comprises at least two melting conductors, preferably between 2 to 10 melting conductors, even more preferably between 3 to 5 melting conductors, which are arranged in the fuse box. In particular, the melting conductors are connected electrically contacting with each other and/or with the contact cap.

The direct current transmission is more preferably a medium voltage direct current transmission (MVDC) and/or a high voltage direct current transmission (HVDC), preferably in a decentralized supply network. Consequently, the high voltage fuse can be used in networks arranged in the medium voltage direct current range and/or in the high voltage direct current range. The medium-voltage direct current range is especially a direct voltage of more than 1 kV, preferably more than 2 kV, more preferably more than 4 kV, and/or less than 50 kV, preferably less than 40 kV, more preferably less than 30 kV. The high-voltage direct current range is especially a voltage range of more than 60 kV, preferably more than 100 kV, even more preferably more than 200 kV.

Preferably, the high voltage fuse is intended for use in a decentralized supply network, with which especially industrial plants, large complexes, for example shopping malls or the like, and/or a majority of households are supplied with electricity. Furthermore, at least one energy conversion plant for power generation, preferably of direct current, can be arranged in the decentralized supply network, by means of which the industrial plants, large complexes and/or the households can be supplied with power. The decentralized supply networks are most preferably so-called island solutions, which are preferably independent of the public power grid.

Preferably, the high voltage fuse can be arranged in a medium voltage direct current transmission network, especially in a medium voltage direct current system. In the medium voltage direct current transmission network, at least one direct current device, especially a MVDC device (Medium Voltage Direct Current Device), can be arranged. The direct current can be made available to the medium-voltage direct current transmission network by an energy conversion plant.

Alternatively or additionally, according to the invention, it may be provided that the direct current comes from a photovoltaic installation and/or a photovoltaic surface installation, especially a solar park, and/or a wind power plant and/or a wind park, especially an off-shore wind park. Alternatively and/or additionally, according to the invention, it is possible that the electricity originating especially from at least one of the aforementioned energy conversion plants is used to supply a self-contained or encapsulated medium-voltage and/or high-voltage network. Thus, especially direct currents originating from renewable energies can be used to supply consumers. Especially, the electricity generated in the aforementioned installations is direct current, which preferably does not have to be converted into alternating current before being fed into the grid.

Preferably, the fuse box of the high voltage fuse is designed as a hollow cylinder and/or tube. The upper and lower side of the fuse box is especially designed to be open, at least in some areas.

The end face of the fuse box can be enclosed by the contact cap, preferably tight. Alternatively or additionally, it can be provided that the contact cap is placed on the end face of the fuse box. In particular, the contact cap is used for electrical contacting, wherein the melting conductor is electrically connected to the contact cap.

Preferably, at least one contact cap covers at least a part of the fuse box, especially a part of the surface in the front area. Due to the overlap in the end face of the fuse box, a fixed arrangement of the contact cap on the fuse box can be guaranteed.

In accordance with an even more preferred embodiment, a further top cap is arranged in front of the contact cap, which is placed on top of the contact cap and/or at least partially covers the contact cap. Thereby the inner contact cap can be designed as an auxiliary cap. The two-part design of the contact cap ensures reliable electrical contact, which is particularly advantageous in long-term use. Furthermore, this design allows a particularly firm connection or arrangement of the contact cap on the fuse box.

According to the invention, the fuse box comprises and/or consists of a ceramic material. Ceramic material is especially a variety of inorganic, non-metallic materials, which can preferably be divided into earthenware, stoneware, crockery, porcelain and/or special masses. As ceramic special masses are preferred electro-ceramics and/or high temperature special masses.

The fuse box can be filled with a extinguishing agent, especially an extinguishing sand filling, preferably quartz sand, and/or air. The extinguishing agent serves in case of switching of the high voltage fuse, especially in case of a short circuit, to extinguish an arc and/or to cool down the possibly melted melting conductor and/or the melting conductor residues.

The melting conductor can be at least partially embedded in the extinguishing agent and/or surrounded by the extinguishing agent so that the extinguishing agent can act on the melting conductor, especially when the melting conductor melts.

The material for the melting conductor is especially silver, preferably fine silver, and/or electrolytic copper. In particular, the melting conductor can be made of the above-mentioned materials. Preferably, the melting conductor is designed as a fine silver strip and/or in strip form.

With an even more preferably embodiment, the fuse box is at least essentially hermetically encapsulated. Hermetic encapsulation and/or locking means an airtight and/or gastight sealing of the system, especially protected from water and/or liquids.

According to a further embodiment of the invention, it is intended that the melting conductors are electrically connected in parallel and/or at least essentially wound helically around the melting conductor carrier. The parallel electrical connection of the melting conductors is advantageous in case of a short circuit and/or the triggering of the high voltage fuse in case of a plurality of melting conductors, since the triggering of only one melting conductor is sufficient for switching. Due to the helical winding of the melting conductor, the length of the melting conductor required for the fuse can be enclosed in the fuse box.

The melting conductor carrier can be made of one piece or several elements. In particular, the melting conductor carrier comprises and/or consists of hard porcelain. In addition, the melting conductor carrier can be designed in such a way that a plurality of chambers is formed, in particular wherein a cross-sectional constriction can be provided in one chamber. Due to the cross-sectional constriction, a large number of partial arcs can occur at each melting conductor when the fuse responds, so that the converted heat quantity can be distributed evenly over the entire length of the fuse tube when the fuse is switched off.

In another, even more preferred embodiment it is intended that the high voltage fuse comprises a release device. The release device can be designed for switching a device connected to the high voltage fuse, especially a transformer switch and/or a load switch, preferably with free release, and/or arranged in a contact cap. Especially the release device comprises a strike pin release mechanism. When the strike pin release mechanism is triggered, it is intended that the strike pin, especially at least essentially cylindrical in shape, breaks through the contact cap, preferably a tightly soldered copper foil.

The strike pin of the striker pin release mechanism of the release device can be triggered by an auxiliary melting conductor. The strike pin is especially triggered in case of a short circuit.

Preferably, a preloaded spring is assigned to the strike pin, wherein the spring can be designed in such a way when the auxiliary melting conductor is tripped, especially in the event of a short, the strike pin emerges from the end face of one of the contact caps.

Especially the strike pin can act on a circuit breaker, which can then switch off the faulty current on all poles.

It is particularly preferred that the auxiliary melting conductor runs over the entire length of the fuse box and/or axially through the center of the melting conductor carrier. Accordingly, the auxiliary melting conductor especially does not have to be wound around the melting conductor carrier.

In addition, the auxiliary melting conductor can be connected in parallel with the melting conductor and/or the melting conductors, especially so that when a melting conductor is melted, a current flows through the auxiliary melting conductor which activates the strike pin.

Preferably, a safety device can be assigned to the release device, which is designed in such a way that after the strike pin has been activated, it can no longer be pressed and/or displaceable into the fuse box. If the strike pin is released, the safety device prevents the strike pin from regaining its position before release. Thus, the load switch to be arranged at the strike pin can be permanently actuated by the strike pin in case of a short circuit—especially as long as the direct current is to remain cut off and/or switched off.

At least one indicating device can be assigned to the high voltage fuse. The indicating device is especially designed for optical indication of a condition. The indicating device can also be arranged in the contact cap. The indicating device can also be used as an alternative to the strike pin release mechanism and indicate the release of the fuse by a visual and/or acoustic signal. Finally, the indicating device serves to inform the operating personnel that the high voltage fuse has been triggered.

According to another embodiment, the contact caps are provided with a galvanic and/or silver coating. The contact caps can comprise and/or consist of electrolytic copper and/or aluminum. The above-mentioned materials allow a good electrical contact.

According to another preferred embodiment, the melting conductor, especially in strip form, is preferably corrugated and/or designed in zig-zag and/or wavy cross section. Ultimately, the corrugated and/or grooved melting conductor can be wound helically around the melting conductor carrier.

Furthermore, the invention relates to a system with a consumer which can be supplied by direct current and with at least one high voltage fuse. The direct current is transmitted to the consumer, wherein the direct current can be protected by the high voltage fuse. Thereby a user is preferably provided as the consumer.

In order to avoid unnecessary repetition, please refer to the previous explanations regarding the use of the high voltage fuse, which also apply in the same way to the system according to the invention. It is understood that the advantages and preferred embodiments of the use according to the invention are also transferable to the system according to the invention.

According to a particularly preferred embodiment, the consumer, which can especially also be made up of a plurality of consumers, comprises a (total) output of more than 5 kW, preferably more than 50 kW, even more preferably more than 700 kW, and/or has a (total) output of less than 3000 MW, preferably less than 2000 MW, even more preferably less than 1000 MW. Furthermore, alternatively or additionally the power of the consumer can be between 50 kW and 3000 MW, preferably between 50 kW and 2000 MW, even more preferably between 700 kW and 1000 MW. Consequently, consumers with a high-power output can also be supplied by the direct current transmission network, which according to the invention is secured by at least one high voltage fuse.

Furthermore, it is understood that in the aforementioned intervals and range limits any intermediate intervals and individual values contained therein are included and are to be considered as essentially disclosed in the invention, even if these intermediate intervals and individual values are not specifically provided.

Further features, advantages and possible applications of the present invention result from the following description of examples of embodiment using the drawing and the drawing itself. Thereby all described and/or pictorially represented features, either individually or in any combination, constitute the subject-matter of the present invention, irrespective of their combination in the claims and their retrorelation.

Figure 1B:
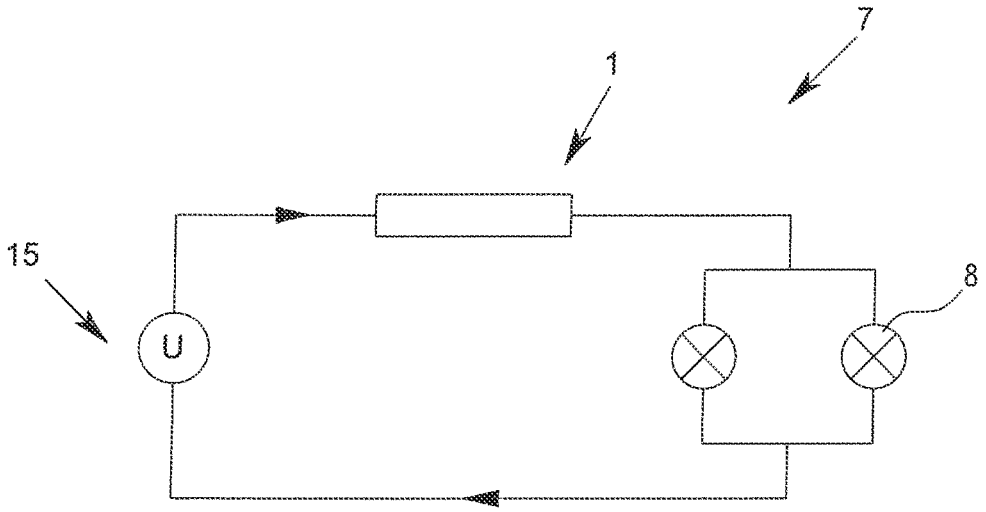
Figure 2:
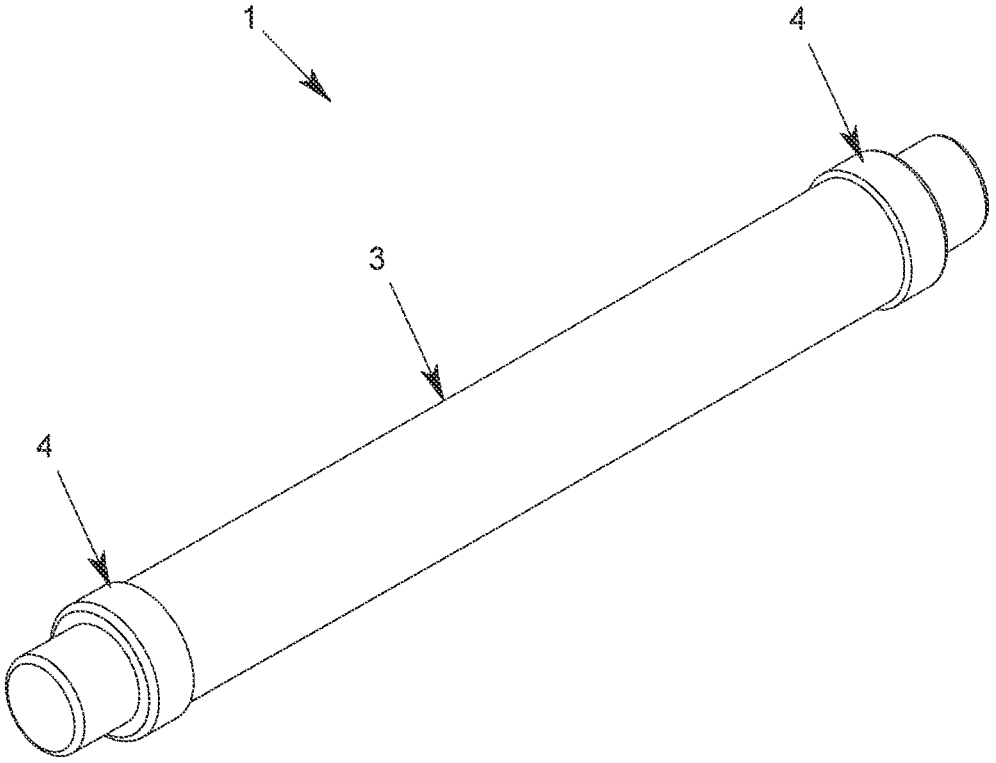
Figure 3:
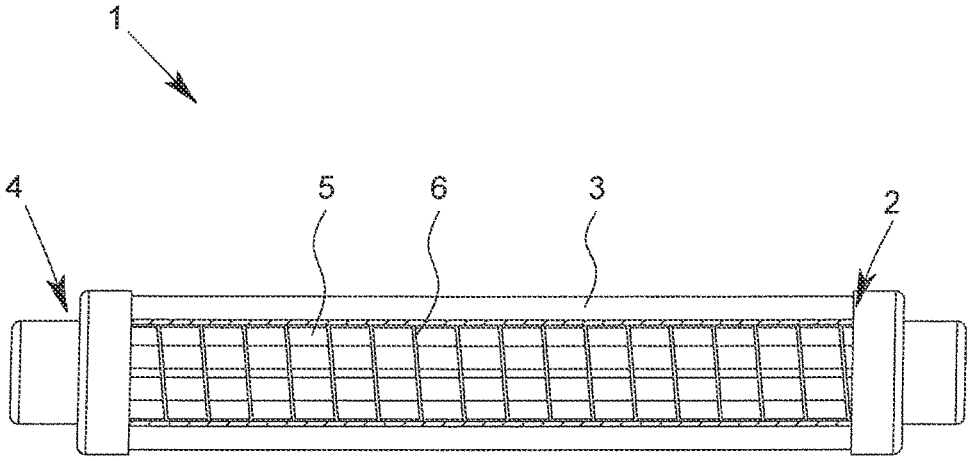
Figure 4:
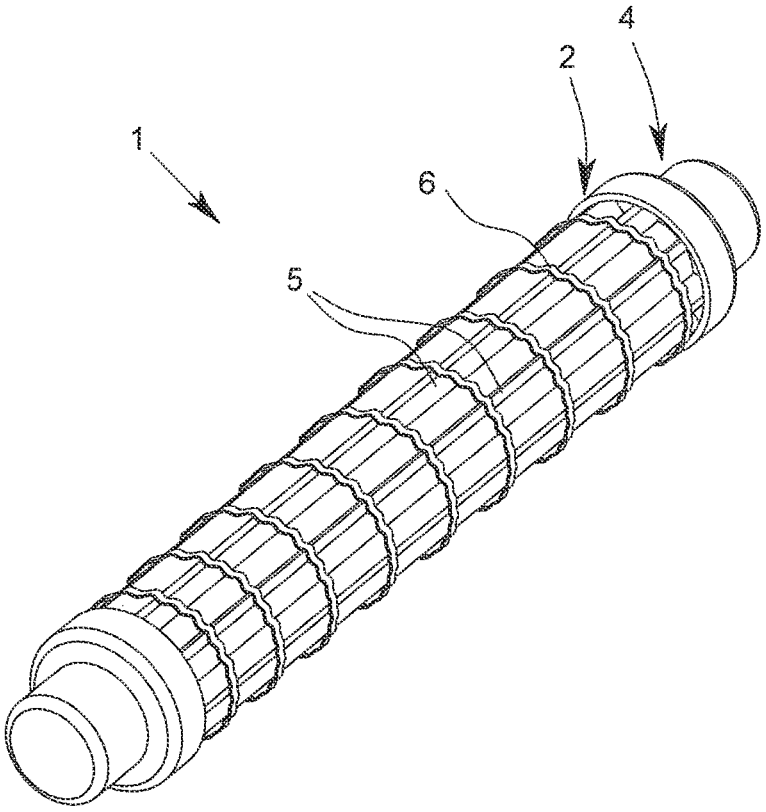
Figure 5:
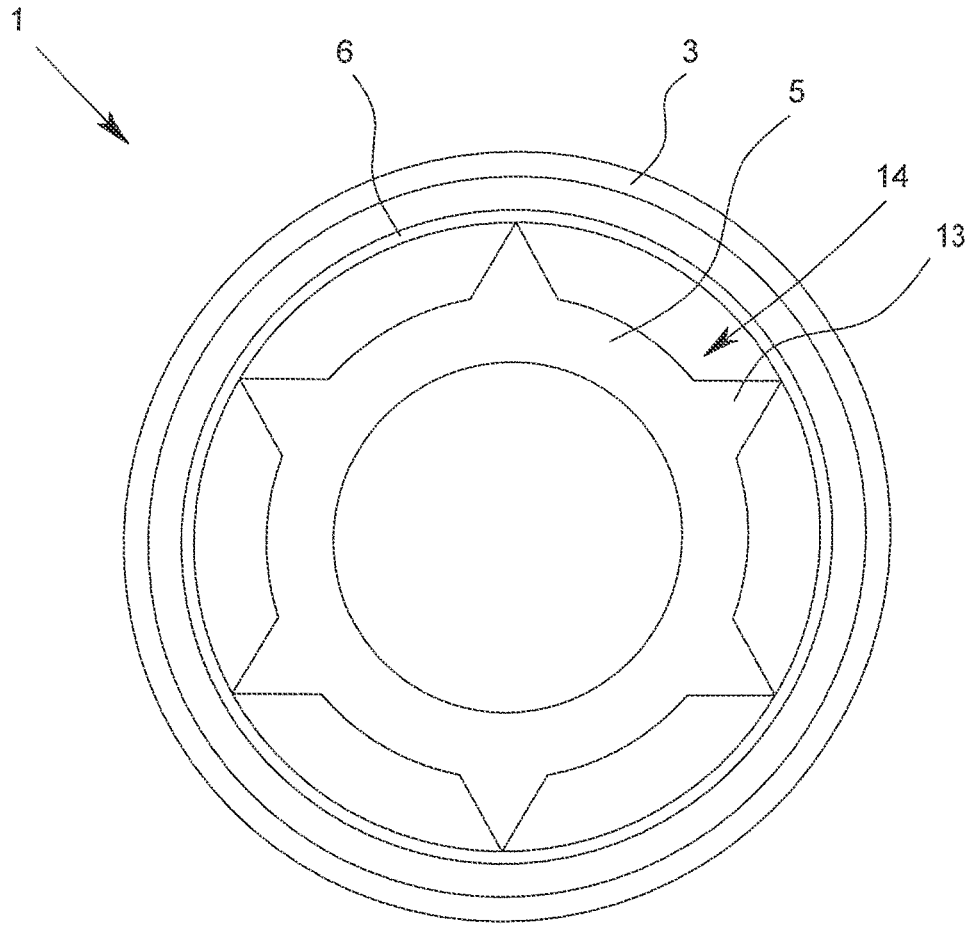
Figure 6:
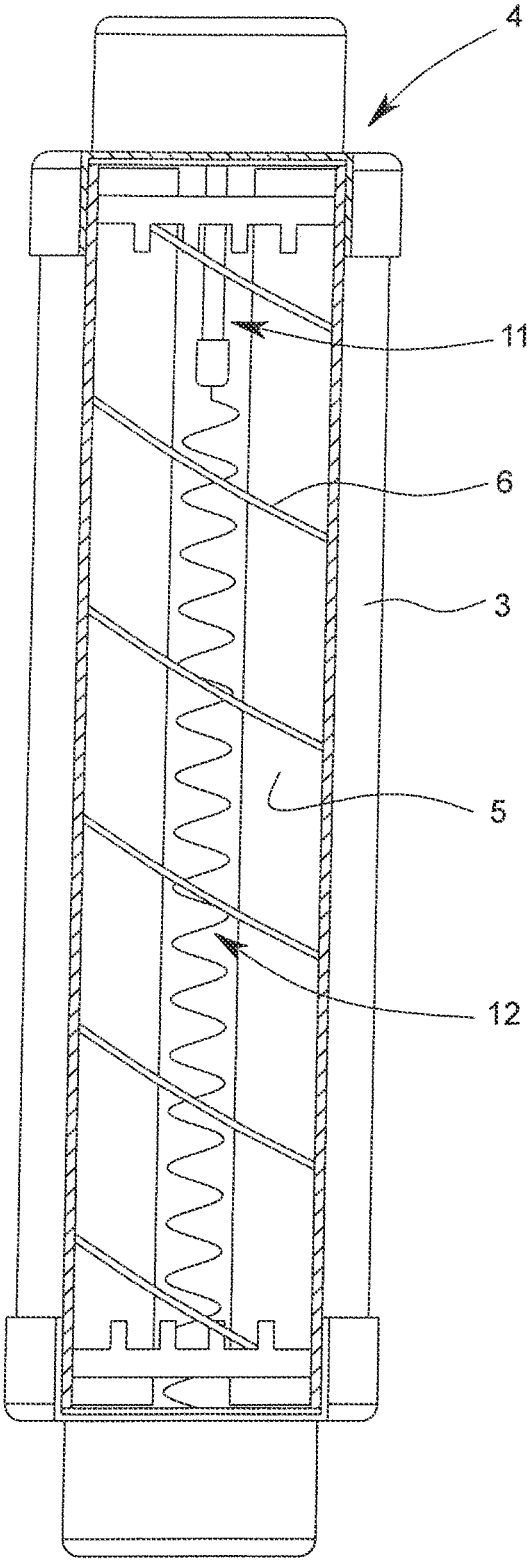

It shows:

FIG. 1A is a schematic diagram of the principle of using a high voltage fuse according to the invention to protect a direct current transmission, FIG. 1B is a schematic diagram of the principle of another embodiment of the use of the high voltage fuse according to the invention for securing direct current transmission, FIG. 2 is a schematic perspective illustration of a high voltage fuse according to the invention, FIG. 3 is a schematic side view of another embodiment of a high voltage fuse according to the invention, FIG. 4 is a schematic perspective illustration of a further embodiment of a high voltage fuse according to the invention, FIG. 5 is a schematic cross-sectional view of another embodiment of a high voltage fuse according to the invention and FIG. 6 is a schematic side view of another embodiment of a high voltage fuse according to the invention.

FIG. 1A shows the use of a high-voltage high capacity fuse 1 (high voltage fuse 1) to protect a DC transmission. In FIGS. 1A and 1B the high voltage fuse 1 is arranged between a direct current source 15 and a consumer 8. The direct current that is transmitted to the consumer(s) 8 flows through the high voltage fuse 1.

The DC voltage of the DC current and/or the rated voltage of the high voltage fuse 1 is thereby greater than 4 kV.

FIG. 2 shows a fuse box 3 as well as contact caps 4 of the high voltage fuse 1. What is not shown is that the fuse box 3 is designed at least essentially open at the two end faces 2.

The contact caps 4 serve for electrical contacting. As can be seen in FIG. 3, at least one melting conductor 6 is arranged in the fuse box 3, which is wound spirally and/or in a helix shape around a melting conductor carrier 5.

FIGS. 3 and 4 show that the melting conductor carrier 5 is essentially designed star-shaped. The star-shaped design of the melting conductor carrier 5 is also shown in FIG. 5. The melting conductor carrier 5 comprises—seen in cross section—protrusions 13 and/or ribs, wherein recesses and/or depressions 14 are provided between the protrusions 13 and/or ribs. The protrusions 13 are thereby designed in such a way that they can be used for at least essentially punctual support of the melting conductor 6. Between the protrusions 13, the melting conductor 6 does not rest on the surface of the melting conductor carrier 5.

In the embodiment shown in FIGS. 1A and 1B, the DC voltage of the direct current is greater than 4 kV and less than 80 kV. In other embodiments, the direct voltage can be between 4 kV and 52 kV. In further embodiments the rated voltage and/or the rated voltage range of the high voltage fuse 1 is greater than 5 kV and/or less than 100 kV and/or is between 4 kV and 100 kV, even more preferably between 5 kV and 80 kV.

Furthermore, when using the high voltage fuse 1 for direct current transmission as shown in FIGS. 1A and 1B, the lowest breaking current of the high voltage fuse 1 is 50 A±20 A. In other embodiments the smallest breaking current of the high voltage fuse 1 can be higher than 3 A and/or lower than 500 A and/or between 3 A and 700 A, preferably between 5 A and 500 A.

The rated breaking capacity and/or the highest breaking current of the high voltage fuse 1 in the embodiment shown in FIG. 3 is greater than 1 kA and/or lies between 20 kA to 50 kA.

The direct current source 15 shown in FIGS. 1A and 1B provides direct current with a current intensity of more than 5 A. Especially, the current intensity of the direct current and/or the rated current range is between 10 A and 75 kA.

As a function of the transmitted direct current and the direct voltage, the product of the direct current and the direct voltage protected by the high voltage fuse 1 can vary. In the embodiment examples shown in FIGS. 1A and 1B, the above product 1000 kW±500 kW. In other embodiments, the product (mathematical multiplication) of the DC current and the direct voltage protected by the high voltage fuse 1 can vary between 5 kW and 3000 MW, especially between 700 kW and 1000 MW.

FIG. 4 shows that at least two melting conductors 6 are arranged in the fuse box 3. In other embodiments it may be planned to use two to ten melting conductors 6.

It is not shown that the direct current transmission is a medium voltage direct current transmission (MVDC) and/or a high voltage direct current transmission (HVDC), especially in a decentralized supply network. The medium voltage direct current transmission comprises a direct voltage of up to 30 kV. High-voltage direct current transmission comprises a direct voltage of over 50 kV.

The high voltage fuse 1 can also be arranged in a medium voltage direct current transmission network, especially in a medium voltage direct current system with at least one MVDC device.

Furthermore, it is not shown that the direct current source 15 is a photovoltaic installation and/or a photovoltaic surface installation (i.e. a solar park) and/or a wind power installation and/or a wind park, especially an offshore wind park. Especially the above-mentioned energy conversion plants provide direct current to the direct current network. The electricity generated by the aforementioned energy conversion plants can be transmitted electrically to consumers 8 secured by at least one high voltage fuse 1.

In addition, FIGS. 1A and 1B show a system 7 with a consumer 8 which can be supplied by direct current. In particular the consumer 8 is a user and/or a plurality of users. Furthermore, system 7 comprises a high voltage fuse 1, which is designed to protect the direct current transmitted to consumer 8. It is not shown that the capacity of consumer 8 is greater than 5 kW and/or less than 2000 MW. Particularly, the high voltage fuse 1 is in-stalled in a direct current network.

FIG. 2 shows that the fuse box 3 is designed as a hollow cylinder and/or tube. The end face of the fuse box 3 is enclosed by the contact caps 4, wherein the contact cap 4 can be placed on the fuse box 3.

FIG. 2 shows that the contact cap 4 covers at least a part of the shell surface 9 in the end face area of the fuse box 3.

It is not shown that the contact cap 4 is associated to a further top cap which is placed in front of the contact cap 4 and at least partially covers the contact cap 4. In this case the contact cap 4 is a so-called inner auxiliary cap.

The fuse box 3 shown in FIG. 2 comprises a ceramic material. In other embodiments, the fuse box 3 can be made of a ceramic material.

It is not shown that an extinguishing agent is provided in the fuse box 3. The extinguishing agent can be an extinguishing sand filling, preferably quartz sand, and/or air.

FIG. 4 shows that the melting conductor 6 is electrically connected to the contact cap 4.

It is not shown that the melting conductor 6 is at least partially, and in particular completely, embedded in and/or surrounded by the extinguishing agent.

Furthermore, FIG. 4 shows that the melting conductor 6 is wave-shaped and/or corrugated, so that—seen in cross-section—a zig-zag shape results. A non-ribbed melting conductor 6 is provided in the design example shown in FIG. 3.

The material of the melting conductor 6 shown in FIG. 4 is silver, especially fine silver. The melting conductor 6 can be designed as a fine silver strip. In other embodiments, the material of the melting conductor 6 comprises and/or consists of electrolytic copper.

Furthermore, it is not shown that the fuse box 3 is at least essentially hermetically sealed.

In the embodiment shown in FIG. 4, the melting conductors 6, which are wound helically around the melting conductor carrier 5, are connected in parallel. The melting conductor carrier 5 shown in FIG. 4 is designed in one piece. In other embodiments, the melting conductor carrier 5 can be composed of several additional elements. Hard porcelain can be used as material for the melting conductor carrier 5.

In a further embodiment, the melting conductor carrier 5 can be designed in such a way that a plurality of chambers is formed, especially wherein a cross-sectional constriction is provided in at least one chamber.

FIG. 6 shows that the high voltage fuse 1 comprises a release device 10. The release device 10 is designed for switching a device connected to the high voltage fuse 1. This device is not shown in the example shown in FIG. 6. The device can be a transformer switch and/or a load switch, preferably with free release. In the example shown in FIG. 6, the release device 10 is arranged at least partially in the contact cap 4.

Furthermore, the release device 10 comprises a strike pin release mechanism. The strike pin 11 can penetrate the top side of the contact cap 4 when the release device 10 is triggered. When in use, the contact cap 4 is enclosed to prevent the penetration of liquids or gases. Further, the embodiment shown in FIG. 6 shows that the strike pin 11 is connected to an auxiliary melting conductor 12. The strike pin 11 can be triggered by the auxiliary melting conductor 12, especially in case of a short circuit. A pretensioned spring can be associated to the strike pin 11. When the auxiliary melting conductor 12 is triggered, this spring is designed in such a way that the strike pin 11 emerges from the end face of one of the contact caps 4. In particular, the strike pin 11 can act on a circuit breaker, which can switch off the faulty current on all poles.

FIG. 6 shows that the auxiliary melting conductor 12 runs over the entire length of the fuse box 3. In addition, the auxiliary melting conductor 12 runs axially through the center of the melting conductor carrier 5.

It is not shown that the auxiliary melting conductor 12 is electrically connected in parallel to the melting conductors 6 and/or the melting conductors 6.

Furthermore, it is not shown that a safety device is associated to the release device 10. The safety device can be designed in such a way that after the triggering the strike pin 11 cannot be pressed and/or displaceable into the fuse box 3 anymore.

Furthermore, it is not shown that at least one indicating device is associated to the high voltage fuse 1 as an alternative or in addition to the strike pin release mechanism. The indicating device can be designed for optical and/or acoustic indication of a condition and can be triggered and/or activated especially when the high voltage fuse 1 is triggered. The indicating device can be at least partially arranged in a contact cap 4.

It is not shown that the contact cap 4 comprises a galvanic coating and/or a silver coating and/or the material electrolytic copper and/or aluminium and/or consists of it.

LIST OF REFERENCE SIGNS

1 high voltage fuse
2 end faces of 3
3 fuse box
4 contact cap
5 melting conductor carrier
6 melting conductor
7 system
8 consumers
9 shell surface of 3
10 release device
11 strike pin
12 auxiliary melting conductor
13 protrusion of 5
14 depression of 5
15 direct current source

The invention claimed is:

1. A high-voltage high-power fuse configured for direct current transmission, wherein a direct voltage of the direct current and/or a rated voltage of the high voltage fuse is greater than 4 kV, wherein the high voltage fuse comprises:

a fuse box which is at least partially open at two end faces, at least one contact cap is arranged at each end face of the fuse box, and at least one melting conductor wound spirally around a melting conductor carrier within the fuse box, wherein the melting conductor carrier is star-shaped, has a hollow core and includes a plurality of points on the star that support the at least one melting conductor and wherein the DC current transmitted and/or the range of rated currents is greater than 5 A and wherein a rated breaking capacity is greater than 1 kA.

2. The fuse according to claim 1, wherein the DC voltage of the direct current and/or the rated voltage of the high voltage fuse is greater than 5 kV and/or is less than 150 kV.

3. The fuse according to claim 1, wherein the minimum breaking current of the high voltage fuse is greater than 3 A.

4. The fuse according to claim 1, wherein the DC current transmitted and/or the range of rated currents is greater than 10 A.

5. The fuse according to claim 1, wherein the product of the direct current protected by the high voltage fuse and the direct voltage is greater than 5 kW.

6. The fuse according to claim 1, wherein at least two melting conductors are arranged in the fuse box and the fuse box includes an extinguishing sand.

7. The fuse according to claim 1, wherein the direct current transmission is a medium voltage direct current transmission (MVDC) and/or high voltage direct current transmission (HVDC), located in one or more of a decentralized supply network, a photovoltaic installation, a photovoltaic surface installation, a wind power installation, a wind park, an offshore wind park, and/or a medium voltage direct current transmission network.

8. The fuse of claim 1, further comprising an auxiliary conductor within the hollow, star-shaped melting conductor carrier.

9. A high-voltage high-power direct current fuse comprising:

a cylindrical fuse box which is at least partially open on two ends, at least one contact cap arranged on one end, at least a second contact cap arranged on an opposite end, extinguishing sand withing the fuse box, at least one hollow, star-shaped conductor carrier within the fuse box, the carrier having a plurality of pointed protrusions, at least one melting conductor wound around the conductor carrier, the plurality of pointed protrusions on the carrier supporting the at least one melting conductor, wherein the fuse is rated for greater than 5 A and 4 kV direct current and wherein a rated breaking capacity is greater than 1 kA.

10. The fuse of claim 9, further comprising an auxiliary conductor within the hollow, star-shaped conductor carrier.

11. The fuse of claim 9, wherein the extinguishing sand fills the fuse box.

12. The fuse of claim 9, wherein the at least one melting conductor is wave-shaped or corrugated.

13. The fuse of claim 9, wherein the at least one melting conductor is a silver strip.

14. The fuse of claim 9, wherein the at least one melting conductor is electrolytic copper.

15. The fuse of claim 9, wherein one or more of the fuse is hermetically sealed and the fuse box includes an extinguishing sand filling.

16. The fuse of claim 9, wherein an auxiliary conductor runs axially within the hollow, star-shaped conductor carrier.

17. The fuse of claim 16, wherein the auxiliary conductor is in parallel to the at least one melting conductor.

* * * * *